US008671691B2

(12) United States Patent
Boardman et al.

(10) Patent No.: US 8,671,691 B2
(45) Date of Patent: Mar. 18, 2014

(54) HYBRID PREFILMING AIRBLAST, PREVAPORIZING, LEAN-PREMIXING DUAL-FUEL NOZZLE FOR GAS TURBINE COMBUSTOR

(75) Inventors: Gregory Allen Boardman, Greenville, SC (US); Ronald James Chila, Greenville, SC (US); Michael John Hughes, Greenville, SC (US); Jason Thurman Stewart, Greenville, SC (US)

(73) Assignee: General Electric Company, Schenectady, NY (US)

( * ) Notice: Subject to any disclaimer, the term of this patent is extended or adjusted under 35 U.S.C. 154(b) by 819 days.

(21) Appl. No.: 12/787,990

(22) Filed: May 26, 2010

(65) Prior Publication Data

US 2011/0289933 A1 Dec. 1, 2011

(51) Int. Cl.
*F02C 1/00* (2006.01)
*F02G 3/00* (2006.01)

(52) U.S. Cl.
USPC ..... 60/737; 60/743; 60/748

(58) Field of Classification Search
USPC ..... 60/748, 742, 67.48, 740, 743, 737, 60/39.463, 239; 239/399, 400, 403
See application file for complete search history.

(56) References Cited

U.S. PATENT DOCUMENTS 3,703,259 A * 11/1972 Sturgess et al. ..... 239/400
3,917,173 A * 11/1975 Singh ..... 239/400
4,854,127 A * 8/1989 Vinson et al. ..... 60/742
6,680,549 B2 1/2004 Boardman et al.
6,761,530 B1 7/2004 Ginessin et al.
6,882,068 B2 4/2005 Weeber et al.
6,921,246 B2 7/2005 Brainch et al.
7,434,401 B2 * 10/2008 Hayashi ..... 60/743
7,484,928 B2 2/2009 Arness et al.
7,963,764 B2 * 6/2011 Brautsch et al. ..... 431/8
8,001,786 B2 * 8/2011 Oda et al. ..... 60/749
8,327,643 B2 * 12/2012 Yamamoto et al. ..... 60/743
2009/0255262 A1 * 10/2009 McMasters et al. ..... 60/742

OTHER PUBLICATIONS

GAO Aviation Safety Advancements Being Pursued to Improve Airliner Cabin Occupant Safety and Health 2003 p. 71 http://www.gao.gov/new.items/d0433.pdf.*
Graco, "Atomization" pp. 8-9.*

* cited by examiner

*Primary Examiner* — Phutthiwat Wongwian
*Assistant Examiner* — William Breazeal
(74) *Attorney, Agent, or Firm* — Nixon & Vanderhye P.C.

(57) ABSTRACT

A dual fuel nozzle for a gas turbine combustor includes a hub defining a fuel inlet and a plurality of liquid fuel jets disposed at a downstream end of the hub. The fuel jets are oriented to eject liquid fuel radially outward from the hub. An annular air passage includes a swirler that imparts swirl to air flowing in the annular air passage, and a splitter ring is disposed in the annular air passage and surrounds the plurality of liquid fuel jets. The nozzle allows liquid fuels to be injected into a swirling annular airstream and then atomized, dispersed and vaporized inside a lean premixing dual fuel nozzle for a gas turbine combustor.

16 Claims, 3 Drawing Sheets

HYBRID PREFILMING AIRBLAST, PREVAPORIZING, LEAN-PREMIXING DUAL-FUEL NOZZLE FOR GAS TURBINE COMBUSTOR

BACKGROUND OF THE INVENTION

The invention relates to a dual-fuel nozzle in a gas turbine combustor and, more particularly, to a hybrid prefilming airblast, prevaporizing, lean-premixing dual-fuel nozzle for a gas turbine combustor that allows liquid fuels to be injected from a removable breech-loaded centerbody stick and then atomized, dispersed, and vaporized.

When fuel is injected in air for combustion in a combustion chamber of the gas turbine, high temperature regions are formed locally in the combustion gas, which increase NOx emissions. Previous designs have used multi-point atomizer injection inside the premixer, but these designs have suffered from high emissions due to maldistribution of the fuel and from poor reliability due to internal (in the fuel passages) and external (on the premixer walls) fuel coking.

BRIEF DESCRIPTION OF THE INVENTION

In an exemplary embodiment, a dual fuel nozzle for a gas turbine combustor includes an annular air passage and a swirler disposed in the annular air passage. The swirler imparts swirl to air flowing in the annular air passage. A splitter ring is disposed in the annular air passage. A hub defines a liquid fuel inlet. A plurality of liquid fuel jets surround a downstream end of the hub and are in fluid communication with the liquid fuel inlet. Each of the plurality of liquid fuel jets is positioned to radially eject liquid fuel into the annular air passage into contact with the splitter ring.

In another exemplary embodiment, a dual fuel nozzle for a gas turbine combustor includes a hub defining a fuel inlet, a plurality of liquid fuel jets disposed at a downstream end of the hub and oriented to eject liquid fuel radially outward from the hub, an annular air passage including a swirler that imparts swirl to air flowing in the annular air passage, and a splitter ring disposed in the annular air passage and surrounding the plurality of liquid fuel jets.

In yet another exemplary embodiment, a method of mixing liquid fuel and air in a dual fuel nozzle for a gas turbine combustor includes the steps of flowing air through the annular air passage and imparting swirl to the flowing air by the swirler; inputting liquid fuel through the fuel inlet; and ejecting liquid fuel radially from the liquid fuel jets into contact with the splitter ring, wherein liquid fuel impinging on the splitter ring forms a fuel film on the splitter ring that mixes with the swirling air flowing in the annular air passage.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
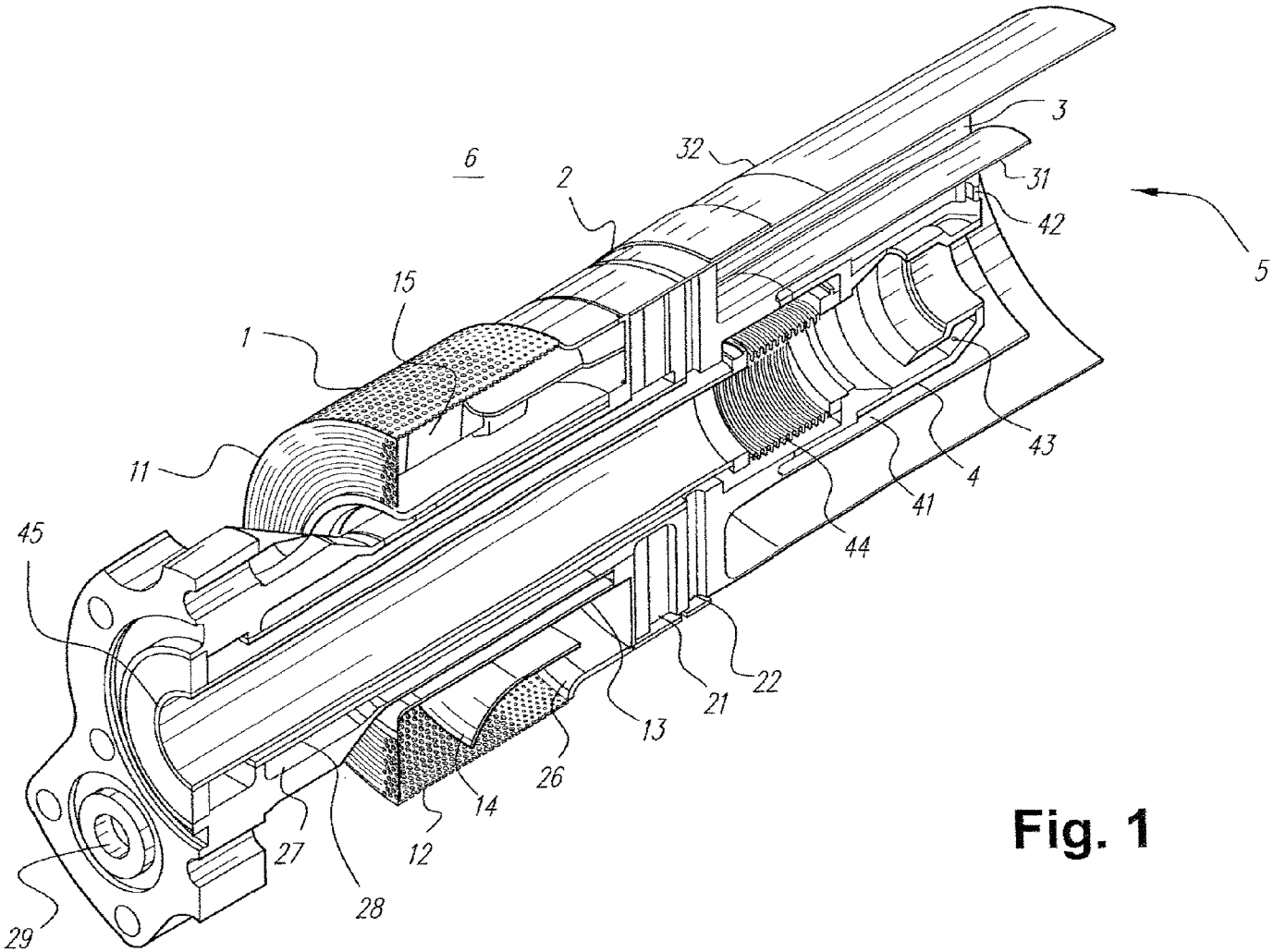
FIG. 1 is a cross-section view through a burner of a gas turbine without a liquid fuel nozzle assembly.

FIG. 1 is a cross-section through an exemplary burner for a gas turbine. In practice, an air atomized liquid fuel nozzle is installed in the center of the burner assembly to provide dual fuel capability. The liquid fuel nozzle assembly has been omitted from FIG. 1 for clarity. The burner assembly is divided into four regions by function including an inlet flow conditioner 1, an air swirler assembly with natural gas fuel injection (referred to as a swozzle assembly) 2, an annular fuel air mixing passage 3, and a central diffusion flame natural gas fuel nozzle assembly 4.

Air enters the burner from a high pressure plenum 6, which surrounds the entire assembly except the discharge end, which enters the combustor reaction zone 5. Most of the air for combustion enters the premixer via the inlet flow conditioner (IFC) 1. The IFC includes an annular flow passage 15 that is bounded by a solid cylindrical inner wall 13 at the inside diameter, a perforated cylindrical outer wall 12 at the outside diameter, and a perforated end cap 11 at the upstream end. In the center of the flow passage 15 is one or more annular turning vanes 14. Premixer air enters the IFC 1 via the perforations in the end cap and cylindrical outer wall.

The function of the IFC 1 is to prepare the air flow velocity distribution for entry into the premixer. The principle of the IFC 1 is based on the concept of backpressuring the premix air before it enters the premixer. This allows for better angular distribution of premix air flow. The perforated walls 11, 12 perform the function of backpressuring the system and evenly distributing the flow circumferentially around the IFC annulus 15, whereas the turning vane(s) 14 work in conjunction with the perforated walls to produce proper radial distribution of incoming air in the IFC annulus 15. Depending on the desired flow distribution within the premixer as well as flow splits among individual premixers for a multiple burner combustor, appropriate hole patterns for the perforated walls are selected in conjunction with axial position of the turning vane(s) 14. A computer fluid dynamic code is used to calculate flow distribution to determine an appropriate hole pattern for the perforated walls.

To eliminate low velocity regions near the shroud wall at the inlet to the swozzle 2, a bell-mouth shaped transition 26 may be used between the IFC and the swozzle.

After combustion air exits the IFC 1, it enters the swozzle assembly 2. The swozzle assembly includes a hub and a shroud connected by a series of air foil shaped turning vanes, which impart swirl to the combustion air passing through the premixer. Each turning vane contains a primary natural gas fuel supply passage and a secondary natural gas fuel supply passage through the core of the air foil. These fuel passages distribute natural gas fuel to primary gas fuel injection holes and secondary gas fuel injection holes, which penetrate the wall of the air foil. The fuel injection holes may be located on the pressure side, the suction side, or both sides of the turning vanes. Natural gas fuel enters the swozzle assembly 2 through inlet ports 29 and annular passages 27, 28, which feed the primary and secondary turning vane passages, respectively. The natural gas fuel begins mixing with combustion air in the swozzle assembly, and fuel/air mixing is completed in the annular passage 3, which is formed by a swozzle hub extension 31 and a swozzle shroud extension 32. After exiting the annular passage 3, the fuel/air mixture enters the combustor reaction zone 5 where combustion takes place.

Figure 2:
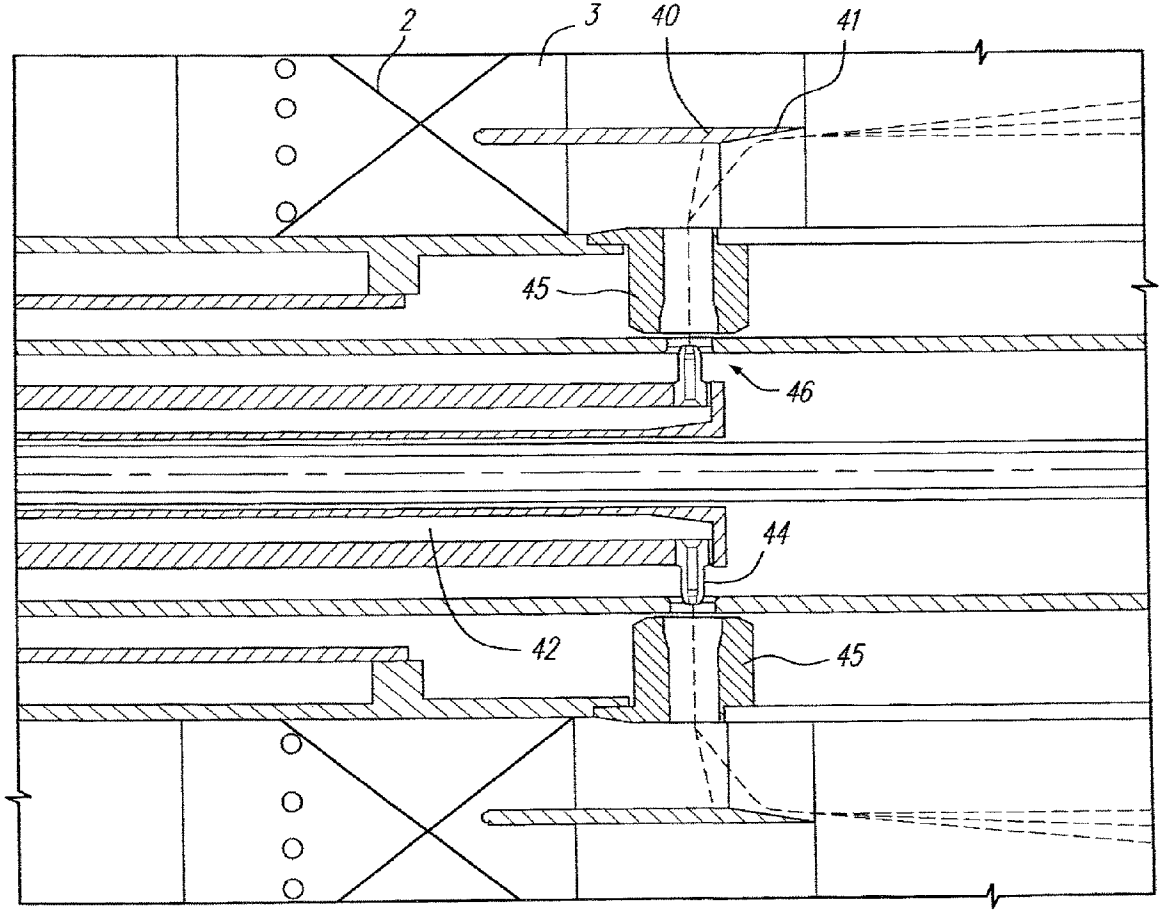
FIG. 2 is a cross-section through a burner including the liquid fuel nozzle.
Figure 3:
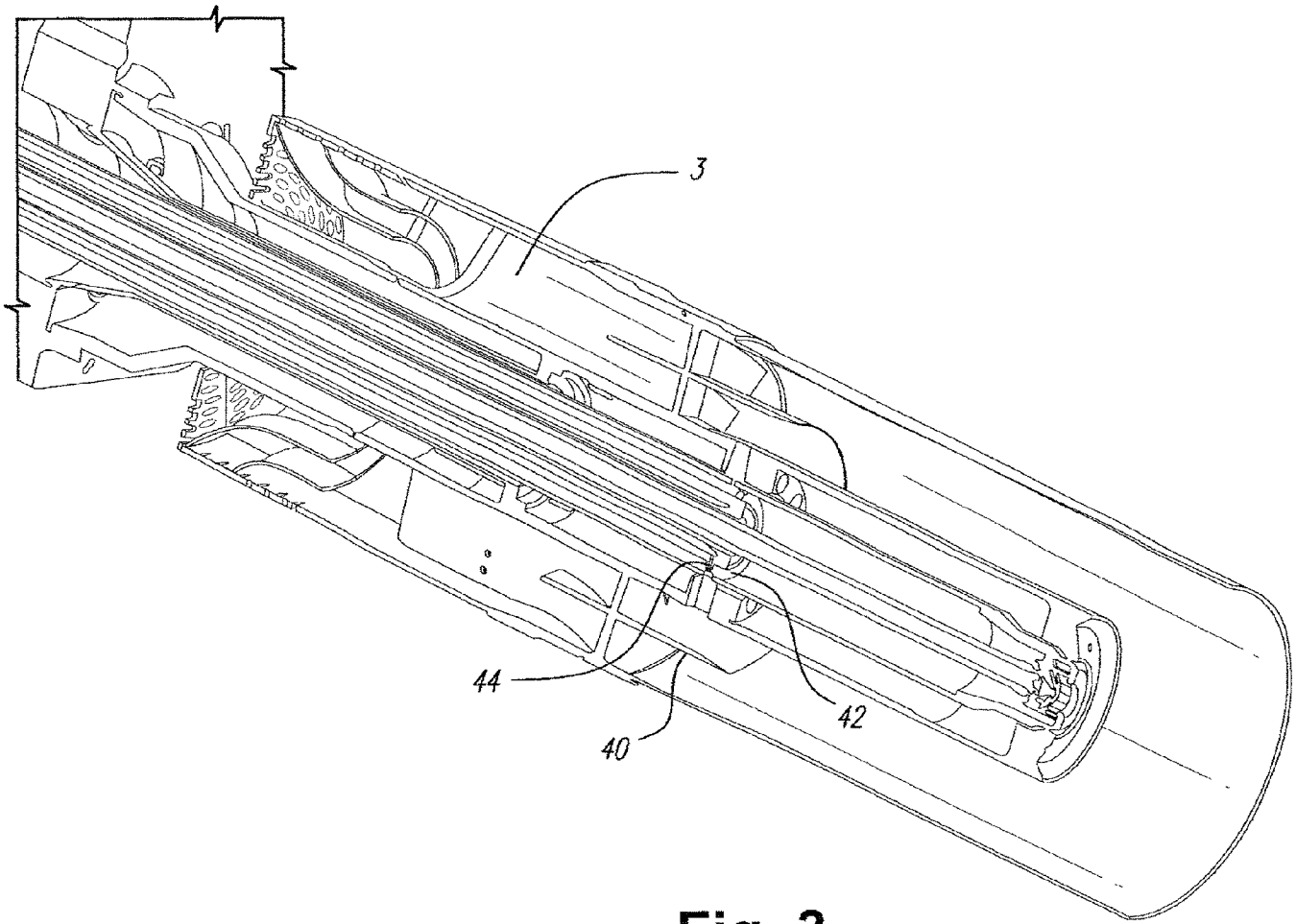
FIG. 3 is a cross-section shown in perspective.

FIG. 2 is a cross-section through a burner including the liquid fuel nozzle via a hub 42. The cross section shows the annular air passage 3 and the swirler 2 disposed in the annular air passage 3. A splitter ring 40 is disposed in the annular air passage 3 adjacent the swirler 2. A leading edge of the splitter ring 40 is positioned about where the turning vanes of the swirler 2 start to turn. The hub 42 defines a liquid fuel inlet/nozzle, and a plurality of liquid fuel jets 44, preferably ten liquid fuel jets 44, surround a downstream end of the hub 42 in fluid communication with the liquid fuel inlet. As shown, each of the liquid fuel jets 44 is positioned to radially inject liquid fuel into the annular air passage 3 into contact with the splitter ring 40.

An atomizer 45 is preferably associated with each of the plurality of liquid fuel jets 44. The atomizer 45 mixes air with the liquid fuel injected from the fuel jets 44. The atomizer defines a cooled atomizing assist air passage that encapsulates and insulates the liquid fuel passages, keeping the fuel-oil wetted wall temperature below the coking temperature (approximately 290° F.). The atomizer 45 includes an airblast slot 46 disposed in alignment with each of the plurality of fuel jets 44. The airblast slots 46 define insulators for the liquid fuel.

It is preferable that the liquid fuel injection parts including the hub 42 are breech-loaded through the combustor end cover, so they can be removed/replaced without disassembling the combustor.

In use, the airblasted liquid fuel jets are injected radially outward from the liquid fuel jets 44 into the axi-symmetric, annular swirling cross flow in the annular air passage 3. The liquid fuel impinges on the splitter ring 40 where it films and is prefilm airblasted off of the splitter ring 40 trailing edge 41, which is preferably tapered as shown. The splitter ring 40 creates a shear layer between two concentric annular streams of swirling air flow. The splitter ring 40 in fact enhances shear, and therefore mixing, by allowing two air streams with different swirl angles to rejoin at the trailing edge of the splitter 40, therefore enhancing shear in the flow to promote mixing. The airblasted film is more evenly azimuthally distributed and has finer droplets than the starting finite number of radial two-phase jets.

Using the prefilming splitter ring 40 prevents overpenetration and fuel impingement on the outer burner tube, allowing the well distributed droplets to rapidly vaporize and premix with the air prior to combustion. The design reduces overall fuel spray drop diameter by re-atomizing larger droplets and improves circumferential (azimuthal) distribution by filming the finite number of impinging jets prior to the prefilm airblasting. The design insulates the liquid fuel passages with sub-300° F. atomizing assist air, thereby preventing internal coking.

With the dual fuel capacity design, the structure allows the nozzle to run on either gas or liquid fuels, both in a lean premixed manner, using the same combustor.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A dual fuel nozzle for a gas turbine combustor, the dual fuel nozzle comprising:

an annular air passage;

a swirler disposed entirely in the annular air passage, the swirler imparting swirl to air flowing in the annular air passage;

a splitter ring disposed in the annular air passage, said splitter ring disposed partially downstream of the swirler for splitting the airflow from the swirler into two portions;

a hub defining a liquid fuel inlet; and a plurality of liquid fuel jets surrounding a downstream end of the hub and in fluid communication with the liquid fuel inlet, each of the plurality of liquid fuel jets being positioned to radially eject liquid fuel into the annular air passage into contact with the splitter ring, wherein the swirler and the plurality of liquid fuel jets are positioned such that fuel/air mixing is completed in the air passage upstream of a combustion zone, and wherein the splitter ring is positioned upstream of a nozzle exit by a distance that permits the liquid fuel to vaporize before combustion.

2. A dual fuel nozzle according to claim 1, further comprising an atomizer associated with each of the plurality of liquid fuel jets, the atomizer mixing air with the liquid fuel ejected from the plurality of fuel jets.

3. A dual fuel nozzle according to claim 2, wherein the atomizer comprises an airblast slot disposed in alignment with each of the plurality of liquid fuel jets.

4. A dual fuel nozzle according to claim 3, wherein the airblast slots define insulators for the liquid fuel ejected from the plurality of liquid fuel jets.

5. A dual fuel nozzle according to claim 1, wherein the hub is removable.

6. A dual fuel nozzle according to claim 1, wherein a trailing edge of the splitter ring is tapered.

7. A dual fuel nozzle according to claim 1, wherein the splitter ring creates a shear layer between two concentric annular streams of swirling airflow.

8. A dual fuel nozzle according to claim 7, wherein the splitter ring enhances shear by allowing two air streams with different swirl angles to rejoin at a trailing edge of the splitter ring.

9. A dual fuel nozzle for a gas turbine combustor, the dual fuel nozzle comprising:

a hub defining a fuel inlet;

a plurality of liquid fuel jets disposed at a downstream end of the hub and oriented to eject liquid fuel radially outward from the hub;

an annular air passage including a swirler disposed entirely within the air passage that imparts swirl to air flowing in the annular air passage; and splitter ring disposed in the annular air passage and surrounding the plurality of liquid fuel jets, said splitter ring disposed partially downstream of the swirler for splitting the airflow from the swirler into two portions, wherein the swirler and the plurality of liquid fuel jets are positioned such that fuel/air mixing is completed in the air passage upstream of a combustion zone, and wherein the splitter ring is positioned upstream of a nozzle exit by a distance that permits the liquid fuel to vaporize before combustion.

10. A dual fuel nozzle according to claim 9, further comprising an atomizer associated with each of the plurality of liquid fuel jets, the atomizer mixing air with the liquid fuel ejected from the plurality of fuel jets.

11. A dual fuel nozzle according to claim 10, wherein the atomizer comprises an airblast slot disposed in alignment with each of the plurality of liquid fuel jets.

12. A dual fuel nozzle according to claim 11, wherein the airblast slots define insulators for the liquid fuel ejected from the plurality of liquid fuel jets.

13. A dual fuel nozzle according to claim 9, wherein a trailing edge of the splitter ring is tapered.

14. A dual fuel nozzle according to claim 9, wherein the nozzle is operable with gas fuel.

15. A method of mixing liquid fuel and air in a dual fuel nozzle for a gas turbine combustor, the gas turbine combustor including a hub defining a fuel inlet, a plurality of liquid fuel jets disposed at a downstream end of the hub and oriented to eject liquid fuel radially outward from the hub, an annular air passage including a swirler disposed entirely within the air passage, and a splitter ring disposed in the annular air passage and surrounding the plurality of liquid fuel jets, the method comprising:

flowing air through the annular air passage and imparting swirl to the flowing air by the swirler, wherein said splitter ring is disposed partially downstream of the swirler, the splitter ring splitting the airflow from the swirler into two portions;

inputting liquid fuel through the fuel inlet;

ejecting liquid fuel radially from the liquid fuel jets into contact with the splitter ring, wherein liquid fuel impinging on the splitter ring forms a fuel film on the splitter ring that mixes with the swirling air flowing in the annular air passage;

positioning the swirler and the plurality of liquid fuel jets such that fuel/air mixing is completed in the air passage upstream of a combustion zone; and positioning the splitter ring upstream of a nozzle exit by a distance that permits the liquid fuel to vaporize before combustion.

16. A method according to claim 15, further comprising insulating the liquid fuel ejected from the liquid fuel jets.

* * * * *